United States Patent [19]

McDowell

[11] 4,434,061

[45] Feb. 28, 1984

[54] SOLIDS-LIQUID SEPARATION

[75] Inventor: Curtis S. McDowell, Allentown, Pa.

[73] Assignee: Cellu-Craft Inc., New Hyde Park, N.Y.

[21] Appl. No.: 185,899

[22] Filed: Sep. 10, 1980

[51] Int. Cl.[3] ..... B04B 5/00

[52] U.S. Cl. ..... 210/787; 210/221.1; 210/512.3

[58] Field of Search ..... 210/781, 780, 787–789, 210/360.2, 379, 220, 221.1, 221.2, 512.1, 512.3; 233/14, 4

[56] References Cited

U.S. PATENT DOCUMENTS

| | | | |
|---|---|---|---|
| 239,659 | 4/1881 | Houston et al. . | |
| 315,876 | 4/1885 | Zimmer . | |
| 1,239,734 | 9/1917 | Sloan et al. . | |
| 1,456,934 | 5/1923 | Rice . | |
| 1,709,916 | 4/1929 | Muhlberg . | |
| 2,669,440 | 2/1954 | Lindenbergh | 210/221.2 |
| 2,710,718 | 6/1955 | Denman | 233/4 |
| 2,808,200 | 10/1957 | Wishaw | 233/14 |
| 2,881,974 | 4/1959 | Ruf | 233/45 |
| 2,893,627 | 7/1959 | Wilkinson, Jr. | 233/14 |
| 3,027,390 | 3/1962 | Thurman | 260/425 |
| 3,438,890 | 4/1969 | Neighbor | 210/14 |
| 3,559,879 | 2/1971 | Bechard | 233/11 |
| 3,829,009 | 8/1974 | Peck | 233/7 |
| 3,865,725 | 2/1975 | Condolios | 210/787 |
| 3,931,928 | 1/1976 | Kido | 233/21 |
| 3,948,771 | 4/1976 | Bielefeldt | 210/788 |
| 3,991,935 | 11/1976 | Henning | 233/23 |
| 3,993,564 | 11/1976 | Novak | 210/360.2 |
| 3,994,809 | 11/1976 | Rhodes | 210/78 |

FOREIGN PATENT DOCUMENTS

| | | |
|---|---|---|
| 1532712 | 3/1970 | Fed. Rep. of Germany . |
| 2318209 | 10/1974 | Fed. Rep. of Germany . |
| 67304 | 2/1958 | France . |
| 1027293 | 4/1966 | United Kingdom . |

OTHER PUBLICATIONS

Robert H. Perry/Cecil H. Chilton, "Chemical Engineers' Handbook" 5th edition, pp. 5–61–5–65.

Brochure entitled "Introducing The Bird Vortex Clarifier" of Bird Machine Company, Inc.–Bulletin BVK101.

"Selecting Sludge Thickening and Dewatering Equipment", Pollution Equipment News, pp. 93–97, Aug. 1978.

J. D. Gullotta and J. D. Boadway, "A High-Capacity Centrifuge for Clarification of Sewage" Water and Polution Control, Jun. 1979, pp. 58–63.

*Primary Examiner*—John Adee

*Attorney, Agent, or Firm*—Posnack, Roberts, Cohen & Spiecens

[57] ABSTRACT

A method and apparatus for continuously separating solids and liquid in a solids-liquid mixture are disclosed. In accordance with the invention, a separation zone for separating solids and liquids from a solids liquid mixture is provided in which the mixture is subjected to centrifugal force under low shear forces and low turbulence. In this zone, the flow rate is maintained to be less than the terminal settling velocity of the solids in the mixture. Further in accordance with the invention, the mixture is introduced into the separation zone from a zone of higher turbulence and higher flow rate than those of the separation zone, a minor part of the mixture in the other zone being removed to the separation zone. The major part of the mixture is removed from the other zone and discharged and returned to the mixture source in such a manner as to aerate the returned mixture. The separated solids are returned to the mixture source with the major part of the mixture. The separated solids and liquid are removed from the apparatus of the invention continuously. The invention is particularly useful in obtaining a highly clarified centrate from sewage sludge.

37 Claims, 5 Drawing Figures

PUMP
22
62
49
52
50
10
44
16
47
14
40A
34
28
41
24
12
31
36
38
40
60B
30
26
60A
20C
32
20A
41
40A
20B
20
56
42A
18
54
59
61
58
46
58
42B
60

Fig. 3.
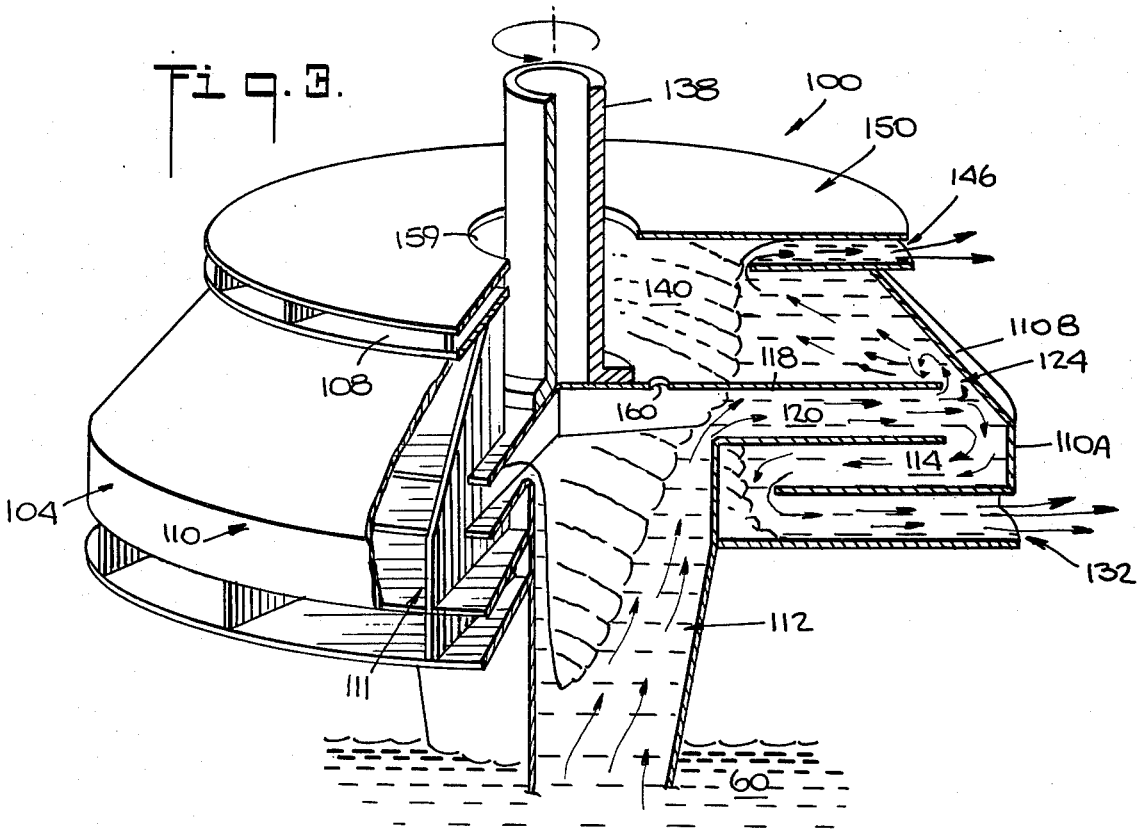
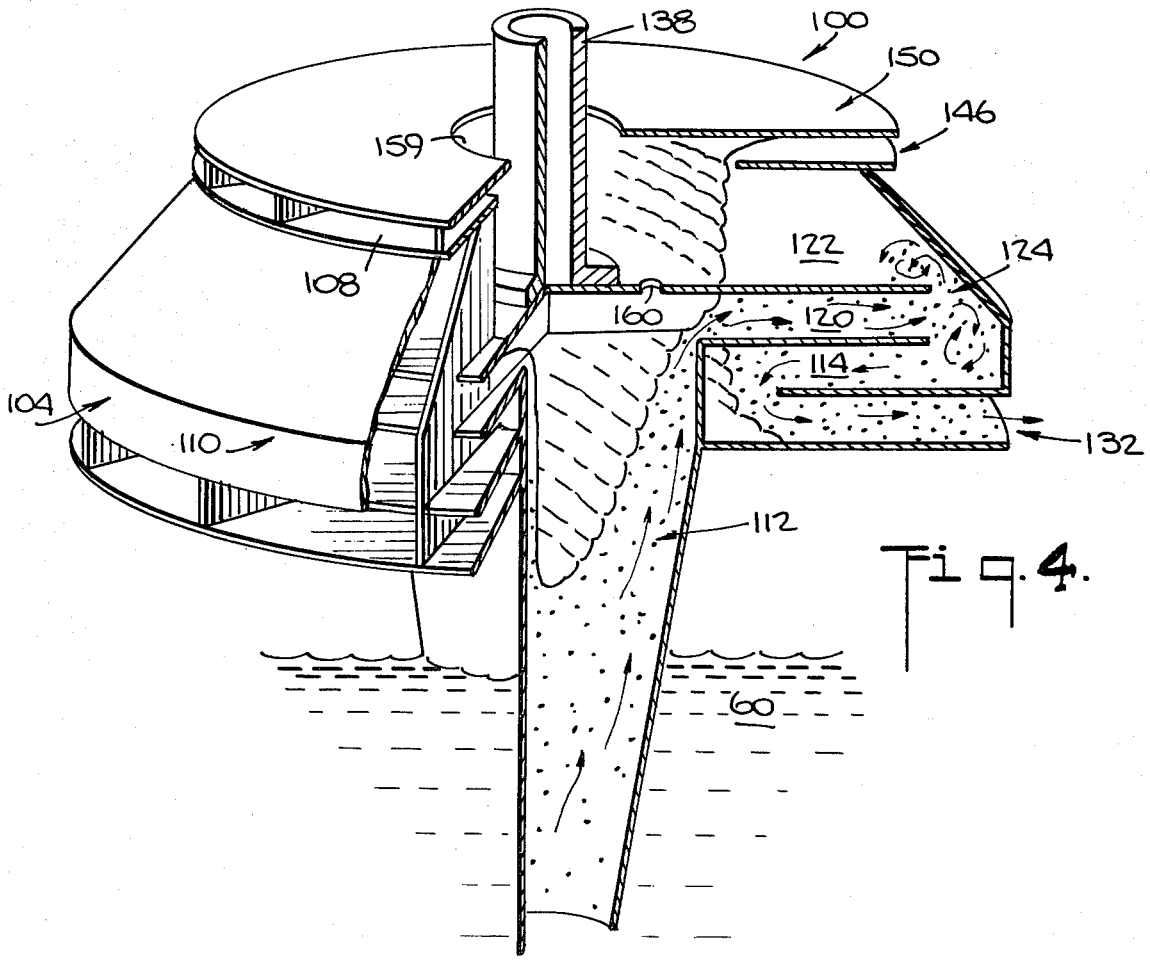
Fig. 4.

SOLIDS-LIQUID SEPARATION

The present invention relates to separation of solids and liquids in a solids-liquid mixture and more particularly to separation of solids and liquids in a sewage sludge mixture. The present invention also relates to the separation of solids and liquids in a sewage sludge or other solids-liquid mixture while aerating the mixture.

With respect to sewage sludge systems, existing continuous flow centrifuges are designed to thicken waste biological sludges. These centrifuges operate in a mode which results in fragmentation of the delicate biological sludges through shearing action in the aqueous phase. The result is a very turbid centrate containing relatively high solids concentration. As far as the applicant is aware, there are no centrifuges designed to provide highly clarified centrates while maintaining uninterrupted flow of both solid and liquid phases; particularly there are no centrifuges designed to provide highly clarified, high quality effluents by continuously separating sludges from the mixed liquor of an activated sludge system.

Applicant is also not aware of centrifugal apparatus or processes which provide for continuous separation of solids and liquids in a solids-liquid mixture and for aeration of the mixture in conjunction with separation.

SUMMARY OF THE INVENTION

It is an object of the present invention to provide a method and apparatus for continuously separating solids and liquids in a solids-liquid mixture.

It is another object of the present invention to provide a method and apparatus for continuously separating solids and liquids in a solids-liquid mixture and to provide a highly clarified effluent liquid.

It is still another object of the present invention to provide a method and apparatus for separating solids and liquids in a solids-liquid mixture and for aerating the solids-liquid mixture in conjunction with separation.

It is also an object of the present invention to provide a method and apparatus for continuously separating biological solids from liquids in a sewage sludge mixture or other biological system.

It is also an object of the present invention to provide a method and apparatus for obtaining a highly clarified effluent from the mixed liquor of an activated sludge system or other biological process system.

It is also an object of the present invention to provide a means of retaining biological sludges or other solids in a system while aerating these solids as a solids-liquid mixture and while discharging a highly clarified or partially clarified effluent as desired.

It is also an object of the present invention to provide a means of retaining biological or other reactive sludges in a reactor vessel while permitting addition of and/or removal of soluble and/or solid materials at will on a continuous uninterrupted flow basis.

It is also an object of the present invention to provide a means of retaining biological and/or other reactive sludges in a reactor vessel while adding or removing liquid or solid materials from the vessel and aerating or mixing the reactor contents with a gaseous reactant.

In accordance with the invention, a separation zone for separating solids and liquids from a solids-liquid mixture is provided in which the mixture is subjected to centrifugal force under low shear forces and low turbulence. In this zone, the flow rate is maintained to be less than the terminal settling velocity of the solids in the mixture. Further in accordance with the invention, the mixture to be separated is supplied to a zone of higher turbulence at a higher flow rate than those in the separation zone and a minor part of the mixture is removed to the separation zone at the lower flow rate.

According to one aspect of the invention, shear forces are eliminated or minimized within a solids-liquid or a sludge-water separation or solids settling zone, while simultaneously providing a means for removing separated solids or sludges from the solids or sludge settling zone. Shear forces are reduced in the settling zone by means such as baffling, for example, which prevent circumferential slippage of the liquid within the settling zone. The baffling may extend transversely to the axis of rotation, preferably radially, or the baffling may extend axially, or both transversely and axially. Prevention of liquid shear or slippage in this zone permits a highly clarified centrate to be obtained.

In accordance with the invention, the mixture to be separated is introduced into a first rotating chamber or region. A minor part of the mixture is removed therefrom and introduced into another rotating chamber or region for separation of the solids and the liquids in the minor part of the mixture. A lower mass flow and turbulence are provided in the other chamber or region as compared to the mass flow and turbulence in the first chamber or region. Clarified liquid is removed from the other chamber or region as upflow while the separated solids are removed from the other chamber or region as downflow. The separated solids are preferably combined with the major part of the mixture downflow from said first chamber or region.

According to another aspect of the invention, the major part of the mixture is removed from the rotating first chamber or region and returned to the source of the solids and liquid mixture in a manner which results in aeration of the mixture.

The method according to the invention for separating solids and liquids in a solids-liquid mixture comprises the steps of subjecting the mixture to be separated to turbulence and centrifugal force in a first zone and removing a minor part of the mixture to a second zone of low turbulence and low shear forces while separating the solids and liquid in the second zone by centrifugal force. The flow rate in the second zone is maintained below the terminal settling velocity of the solids in the mixture.

More particularly, the method comprises the steps of continously introducing mixture to be separated into a first region, zone or chamber, rotating the first region with the mixture therein and creating a first flow turbulence, removing a minor part of the mixture into a second region, zone or chamber, rotating the second region with the minor part of the mixture therein and creating a second flow turbulence, separating the solids and liquid in the minor part of the mixture in the rotating second region, and removing the separated solids and liquid from the second region; the first and second regions having differing flow turbulence, the second flow turbulence being less than the first flow turbulence. The mass flow in the second region is maintained substantially less than the mass flow in the first region and the mass flow in the second region is maintained below the terminal settling velocity of the solids in the mixture. Shear forces are maintained low in the second region while subjecting the mixture to the centrifugal force obtained by rotation.

Apparatus according to the invention for continuously separating solids and liquids in a solids-liquid mixture and continuously removing the separated solids and liquids from the apparatus comprises an upstream chamber and a downstream chamber connected in the apparatus for rotation about an axis of rotation, means for communicating the upstream chamber and the downstram chamber, means for introducing influent mixture into the upstream chamber, first means for removing effluent from the upstream chamber and second means for removing effluent from the downstream chamber. The means for communicating and the first means are operative during rotation of the chambers to remove a minor part of the mixture in the upstream chamber to the downstream chamber through the means for communicating and to remove the major part of the mixture in the upstream chamber therefrom. Rotation of the chambers is operative to separate the solids and the liquids in the minor part of the mixture in the downstream chamber, the separated liquid in the downstream chamber being removed therefrom by the second means and the separated solids in the downstream chamber being removed therefrom by the means for communicating and the first means.

In the disclosed embodiments, each chamber is defined by respective axially spaced upstream and downstream surfaces which extend outwardly with respect to the axis of rotation, and spaced surfaces extending between respective upstream and downstream surfaces and between the axis of rotation and each chamber periphery.

A means for separating each chamber into an upstream region and a downstream region is disclosed to comprise a member in the chamber which extends outwardly, preferably radially from at or adjacent to the axis of rotation to adjacent the periphery of the chamber.

The upstream and downstream chambers may comprise regions of a chamber connected in the apparatus for rotation about an axis of rotation. Preferably, the means separating the chamber into the upstream region and the downstream region comprises a baffle extending radially from at or adjacent to the axis of rotation of the chamber to adjacent the peripheral region.

In the disclosed embodiments, the upstream and downstream chambers or regions are structured such that the flow turbulence in the upstream chamber or region is substantially higher than the flow turbulence in the downstream chamber or region. Using Reynolds numbers as an indication of flow turbulence, the downstream chamber or region has a Reynolds number which is substantially less than Reynolds number in the upstream chamber or region. For example, the downstream chamber or region has a Reynolds number less than about 3000 while the upstream chamber or region has a Reynolds number of from about 3000 to about 200,000 or greater.

In the disclosed embodiments, the means for communicating the upstream and downstream chambers or regions are disposed so as to communicate the upstream and downstream chambers or regions at a first location spaced outwardly from the axis of rotation, the means for communicating being the peripheral region in the chamber between the chamber periphery and an outwardly-extending member.

Also, in the disclosed embodiments: the means for introducing influent mixture into the upstream chamber or region is disposed so that mixture is introduced into the upstream chamber or region at a second location inwardly of the first location; the means for introducing influent is communicated with the upstream region at or adjacent to the axis of rotation of the chamber; the first means for removing effluent from the upstream chamber or region is communicated with the upstream region at or adjacent to the peripheral region and is disposed so that effluent is removed from the upstream chamber or region outwardly of the second location; and the second means for removing effluent from the downstream chamber or region is disposed so that effluent is removed from the downstream chamber or region inwardly of the means for communicating the upstream and downstream chambers.

In accordance with a preferred embodiment, a plurality of circumferentially disposed chambers or regions are provided.

These and other aspects of the invention will be more apparent from the following description of the preferred embodiments thereof when considered with the accompanying drawings and appended claims.

BRIEF DESCRIPTION OF THE DRAWINGS

The present invention is illustrated by way of example and not limitation in the figures of the accompanying drawings in which like references indicate similar parts and in which:

FIG. 3 is a perspective view partially in section of the separator of FIG. 2 depicting the fluid flow in the apparatus; and FIG. 4 is a perspective view partially in section of the apparatus of FIG. 2 depicting particle distribution and flow.

DESCRIPTION OF THE PREFERRED EMBODIMENTS

Referring more particularly now to the drawings, a single chamber separator apparatus 10 (FIG. 1) and a multichambered separator apparatus 100 (FIG. 2) are illustrated.

Figure 1:
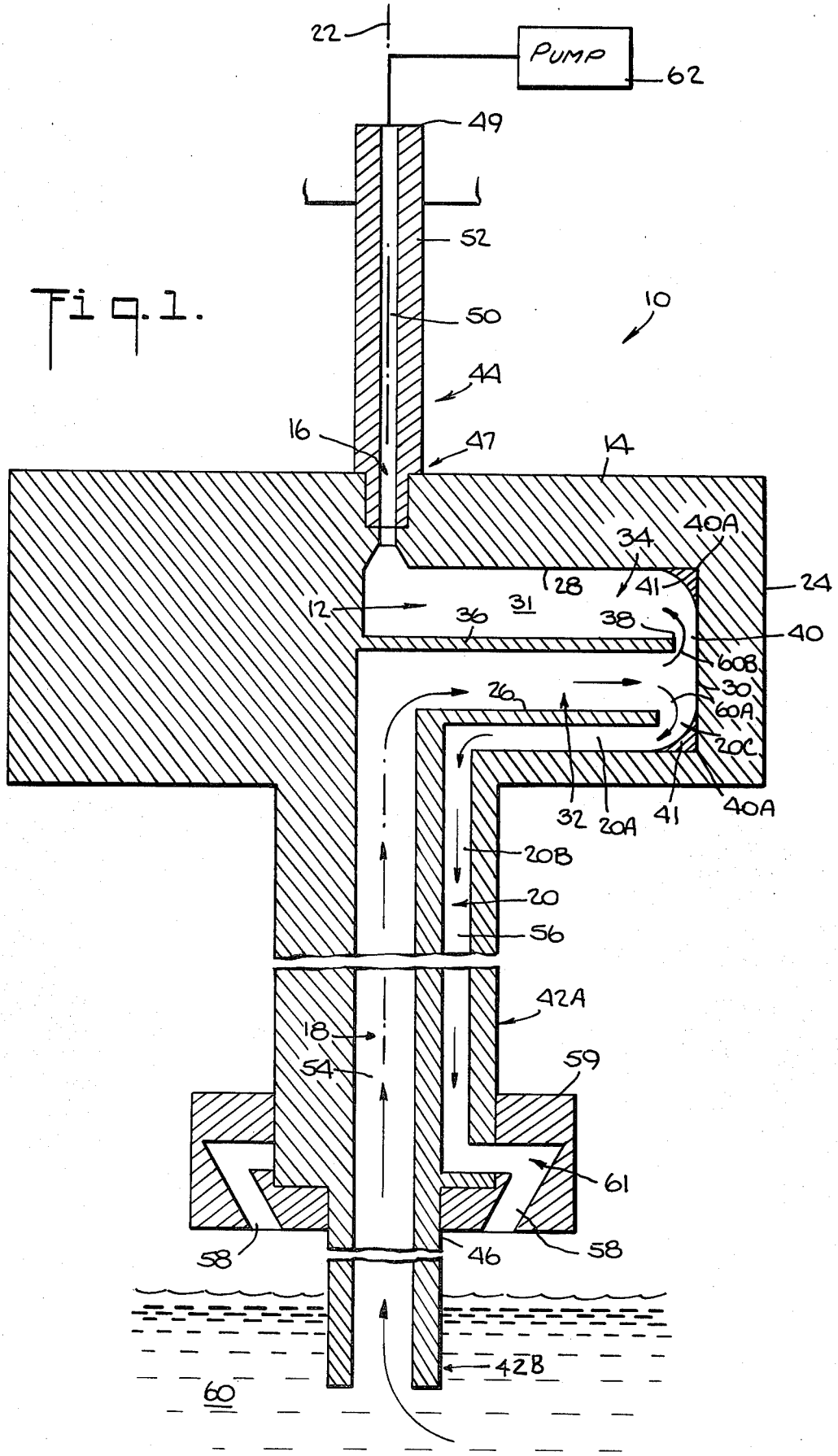
FIG. 1 is an axial section view of a single chamber separator apparatus according to one embodiment of the invention.

The separator apparatus 10 in FIG. 1 includes a single chamber 12 formed in a chamber housing 14. The chamber housing 14 is solid, except for the chamber 12 therein and the passages 16, 18 and 20 communicating with the chamber 12. The chamber housing 14 with the chamber 12 disposed therein is connected in the apparatus 10 for rotation about the axis 22. The chamber 12 extends (in cross-section) radially in chamber housing 14 from adjacent the axis of rotation 22 to adjacent the periphery 24 of the chamber housing. The chamber is formed by an outwardly-extending (in cross-section) upstream surface 26, an outwardly-extending (in cross-section) downstream surface 28 and a generally axially-extending (in cross-section) peripheral surface 30. The chamber 12 is further defined by spaced surfaces 31 which extend axially between the upstream 26 and downstream 28 surfaces and radially from adjacent the axis of rotation 22 to the peripheral surface 30. Passage 16 is the upflow effluent passage and is communicated with the chamber 12 adjacent the axis of rotation 22 through the downstream surface 28. Passage 18 is the influent passage and is communicated with the chamber 12 adjacent the axis of rotation 22 through upstream surface 26. Passage 20 is the downflow effluent passage and is communicated with chamber 12 adjacent the peripheral surface 30.

The chamber 12 is separated into an upstream region 32 and a downstream region 34 by a radially-extending (in cross-section) baffle 36. The baffle 36 radially extends from adjacent the axis of rotation 22 to adjacent the peripheral surface 30 and circumferentially between surfaces 31. Between the extremity 38 of baffle 36 and the peripheral surface 30 of the chamber 12 and between the upstream 26 and downstream 28 surfaces of the chamber is formed a peripheral region 40. In order not to leave a dead space, the peripheral corners 40A of both the upstream and downstream chambers may be filleted or the upstream and downstream surfaces may include sections having axially-extending components which extend towards the center of the chamber peripheral surface 30. This is generally referenced by fillets 41 in FIG. 1.

In addition to chamber housing 14, the apparatus 10 includes an upstream section 42A, 42B and a downstream section 44, both sections extending axially (in cross-section) from the chamber housing 14. Sections 42A, 42B and 44 rotate with the chamber housing 14 about the axis 22, suitable means, for example bearing means, being provided, at 46 and or 47 for example, to support the apparatus and permit rotation thereof about axis 22. In one embodiment, a rotating seal is provided at 49 and pump 62 draws liquid through upflow passage 16. In another embodiment (FIG. 1A), a liquid seal is provided at 48 and a pump 63 draws the solids-liquid mixture into the passage 18. Conventional drive means, not shown, are provided to effect rotation of the apparatus 10.

In the embodiment shown in FIG. 1, the passage 16 extends axially downstream along the axis of rotation 22 from the downstream region 34 of the chamber to an effluent port at 49 and is formed as the bore 50 of a hollow rotating shaft 52. The influent passage 18 extends axially upstream from the chamber 12 along the axis of rotation 22 through sections 42A and 42B to a source or reservoir of the solids-liquid mixture, and is formed as a central, axially-extending bore 54 in sections 42A, 42B. The downflow effluent passage 20 extends radially inwardly (20A) in housing 14 and axially (20B) from housing 14 in the upstream section 42A, and is formed as another axially extending bore radially offset from axis 22 in section 42A. Passage 20 terminates at ports 58 after passing through a liquid trap which prevents a syphon break in passage 20. A sleeve 59 is rotatably mounted on section 42A by means of a slip-fit, for example, and can be manually rotated relative to section 42A to act as a control valve for the rate of discharge from ports 58. Passage 61 in sleeve 59 is circumferential and provides passage of discharge from two diametrically opposed ports 58 to maintain balance.

In operation, the influent passage 18 is communicated with a source or supply of a solids-liquid mixture 60, i.e., the central bore 54 of the upstream section 42 is disposed in the solids-liquid mixture 60. Additionally, the effluent ports 58 are disposed in the mixture at least initially for priming. A pump 62 is communicated with the downstream bore 50 of shaft 52 and a rotating seal is also provided at 49 between the pump and the shaft. The chamber housing and the upstream and downstream sections of the apparatus are rotated and mixture 60 is drawn into the central bore 54 of the downstream section 42A, 42B intially by means of pump 62. Mixture is also drawn into the effluent ports 58. Pumping by pump 62 eventually causes the mixture to progress in passages 18 and 20 and enter the upstream, peripheral and downstream regions of the chamber and thereafter enter downstream passage 16. Air is thus displaced by mixture in the passages 16, 18, 20 and in chamber 12 to prime the apparatus. Rotation of the apparatus causes the mixture in the chamber to move centrifugally outwardly and provides a built-in pumping action which draws mixture into the upstream region 32 of the chamber via passage 54.

Figure 1A:
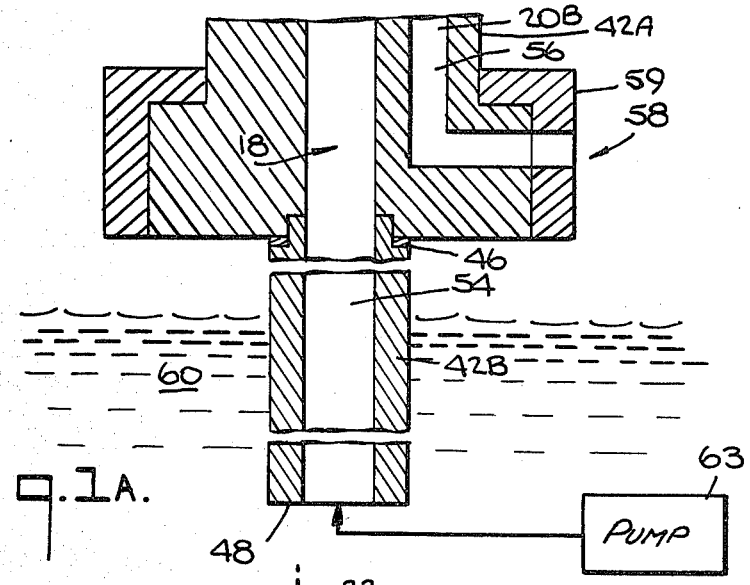
FIG. 1A is an axial section view of a portion of the single chamber separator apparatus of FIG. 1 illustrating an alternate connection for the pump which draws mixture into the apparatus.

Alternatively a pump 63 is connected as shown in FIG. 1A through a rotating seal to the bore 54 of the downstream section 42B to draw mixture into the apparatus.

Once the apparatus is primed, ports 58 may be raised from the solids-liquid mixture and centrifugal force will cause the mixture in the upstream region 32 of the chamber 12 to move radially outwardly with a part thereof eventually being discharged from ports 58 through passage 20. According to the invention, the pumps and pumping action are selected so that a major part of the mixture entering passage 54 is removed from the upstream region 32 through passage 20 and a minor part is removed to the downstream region. More specifically, a major part 60A of the solids-liquid mixture in the upstream region 32 is withdrawn therefrom through the fownflow effluent passage 20, while a minor part 60B progresses upstream through the peripheral region 40 into the downstream region 34 of the chamber 12. The rate of flow of the minor part of the mixture 60B is determined by the pump 62 and the rate of flow of the major part of the mixture 60A is determined by the pumping action of the rotating apparatus or by the pump 63. Thus, the pump 62 and pump 63 or rotating action of the apparatus are primarily responsible for the relative division of the mixture in region 32.

Upstream region 32 is intended to be a turbulent zone in which little or no separation takes place and downstream region 34 is intended to be quiescent zone in which turbulence is substantially reduced as compared to that in the upstream region 32. The baffle 36 isolates the quiescent zone from the turbulent zone so that the minor part 60B of the mixture 60 drawn into the downstream region 34 is not subjected to high shear forces. Thus, quiescent conditions are established in downstream region 34 so that the solids are subjected to high centrifugal forces, but low shear forces, and move radially outwardly, the liquid moving radially inwardly. The separated solids flow axially upstream as downflow through the peripheral region 40 and are entrained in the major part 60A of the mixture moving through the downflow effluent passage 20.

The turbulence in upstream region 32, downflow effluent passage 20 and the peripheral region 40 is dependent upon the flow rates as discussed. For a given mass flow of mixture 60, the turbulence increases in region 32 as flow approaches the peripheral surface 30. The increasing turbulence as region 32 flow approaches the peripheral region 40 assures suspension and flow of solids in these regions. The radial cross-sectional area of the peripheral region 40 is determined by the distance that baffle 36 extends radially from the axis of rotation. The cross-sectional area of region 40 regulates the turbulence in region 34 adjacent to peripheral region 40. The regulated turbulence in region 34 adjacent peripheral region 40 coupled with the relatively low flow rate of the minor part of mixture 60B in regions 40 and 34 serve to rapidly decrease turbulence and relative velocity of flow in these regions. Solid particles, no longer being suspended by flow or turbulence, are centrifugally thrown toward the downstream peripheral walls 30 and 41 and into peripheral region 40 where turbulence is higher and they can be re-suspended with the major portion of mixture 60A at the entrance 20C to the downflow effluent passage 20.

The circumferential width of the chamber 12 is limited by the spacing between surfaces 31. The spacing is selected to provide low or limited shear forces between the baffle 36 and the mixture and between the chamber surfaces and the mixture. Thus, circumferential slippage is reduced or eliminated between the mixture and the surfaces in the quiescent downstream region.

A major part 60A of the influent mixture 60 in upstream chamber 32 is removed therefrom as described and progresses as downflow through bore 56 to be discharged through effluent ports 58. The minor part 60B of the mixture 60 progresses into the downstream region 34 where separation of the solids and liquid in the mixture takes place, the separated solids being again entrained in the major part 60A of the mixture and removed from the apparatus as downflow through ports 58 and the separated liquid being removed as upflow through downstream passage 16.

By way of example, the fluid motion in the chamber 12 may be described by means of Reynolds numbers associated with the different regions of the chamber. Noting that turbulent flow occurs at Reynolds numbers above about 3,000, the Reynolds number in the upstream region turbulent zone is from about 3,000 to about 200,000, or greater. The Reynolds number is reduced in the peripheral region 40 and in the downstream region quiescent zone is lss than about 3,000. In addition the flow velocities in upstream region 32 and in the radially inwardly projecting downflow effluent passage 20 must be such that the terminal settling velocity of the solids particles suspended in mixture 60 are exceeded. The flow velocities in downstream region 34 and in the portions of the peripheral region 40 which are adjacent the downstream region 34, must be less than the terminal settling velocities of the solid particles in mixture 60. The separated liquid upflow is removed as a highly clarified effluent by pump 62 while the separated solids and the major part of the mixture are returned to the reservoir. It is to be noted, however, that the centrifugal action in the rotating chamber 12 assists in pumping the major part of the mixture 60A in that once primed by pump 62 with ports 58 submerged, the device may be elevated so that liquid discharging from ports 58 is so released above the surface of mixture 60 and causes by passage through air and by impact with mixture 60, the aeration of the mixture 60. Alternatively to submergence of ports 58 during priming, pump 63 can be used to prime device 10 after which centrifugal pumping action of the device will maintain flow in the upstream region. It is possible by the use of pump 63 and proper restriction of flow at ports 58, to eliminate the need for pump 62.

In use for separating sewage sludge, mixture enters the quiescent sludge settling zone 34 flowing at a rate determined by the pump 62. By keeping this flow rate low relative to the cross sectional area of the sludge settling zone 34, it is possible to establish quiescent conditions within this zone such that the sludge is exposed to high centrifugal forces but very low shear energy. As a result, the sludge settles rapidly toward the periphery or outer wall of region 34. Turbulence in the turbulent flow zone 32 carries over into the peripheral region 40 and the entrance to the quiescent zone 34 and causes the separated sludges to be entrained in the mixed liquor flowing through the turbulent flow zone. Thus, the sludge settling zone is kept reasonably quiescent while separated sludges are continously removed from the zone.

Apparatus 10 thus provides for separation of liquids from the mixture and removal thereof from the apparatus on a continuous basis and for separation of solids from the mixture and removal thereof from the apparatus on a continuous basis, i.e., the apparatus need not be stopped and the process discontinued to remove separated liquids and/or separated solids.

As described above, the effluent ports 58 are intially submerged to prime the apparatus. Thereafter, the effluent ports may be removed from the mixture and in accordance with one aspect of the invention are raised above the mixture level. This is done so that a vertical distance is provided between the effluent ports 58 and the mixture, thus allowing the downflow effluent discharged to fall through air in a trajectory established by centrifugal force and gravity before reaching the mixture. The downflow effluent also impacts the surfaces of the containing vessel or the mixture 60 causing entrainment of air in the mixture. Thus, the downflow effluent which includes a major part of the mixture introduced into the apparatus is aerated in conjunction with separation and through impact aerates the mixture as a whole on a continuous basis.

Figure 2:
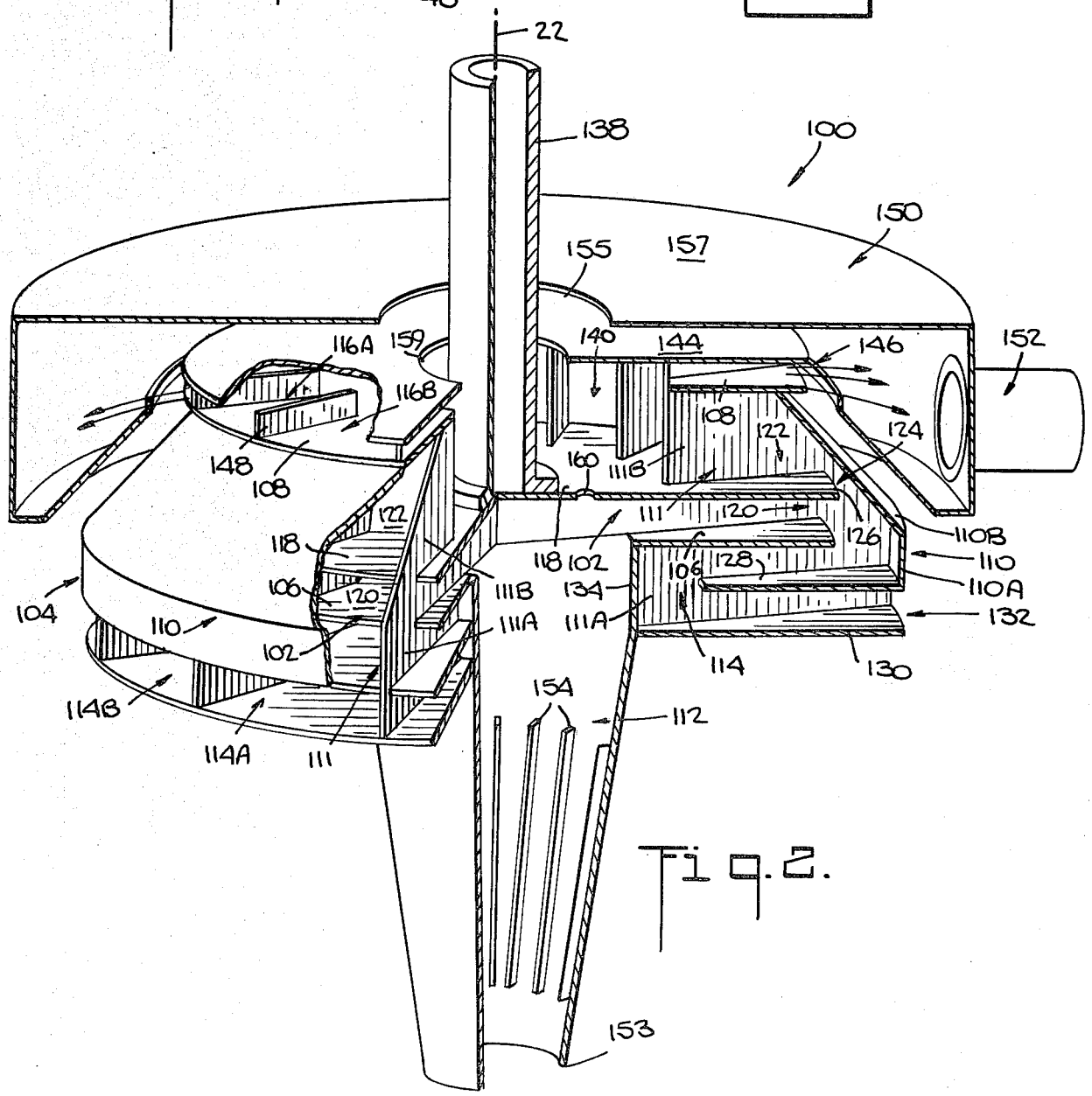
FIG. 2 is a perspective view partially in section of a multi-chamber separator according to the invention.

Referring now to FIG. 2, a multi-chambered separator apparatus 100 is illustrated. Apparatus 100 includes a chamber housing 104 which rotates about axis 22 and is partitioned into chambers 102. The chambers 102 in the housing 104 extend generally radially from or adjacent to the axis of rotation 22 as described for the single chamber of apparatus 10. Each chamber is circumferentially juxtaposed in housing 104 and is formed by a respective upstream baffle 106, a respective downstream baffle 108 and one or more peripheral surfaces 110. Adjacent chambers are separated by axially-extending circumferentially-spaced baffles 111, i.e. the baffles 111 partition the housing 104 into the chambers 102. Although each of the chambers 102 is illustrated to be identically structured, the chambers need not be identical and may, for example, have diffferent dimensions. Influent is introduced into the chambers 102 by an influent passage referenced generally by 112 and downflow effluent is removed from the chambers 102 by a downflow effluent passage referenced generally by 114. An upflow effluent passage referenced generally by 116 is also communicated with chamber 102.

A baffle 118 radially extending from or adjacent to the axis of rotation 22 to adjacent the peripheral surfaces 110 separates the chamber 102 into an upstream region 120 and a downstream region 122. A peripheral region 124 is formed adjacent to the extremity 126 of baffle 118 and the peripheral surfaces 110. The downflow effluent passage 114 is formed by the upstream baffle 106, a baffle 128 and another baffle 130 in the chamber housing 104. The downflow effluent passage 114 is sinuous, extending first radially inwardly, then making a u-turn around baffle 128 and thereafter preceeding radially outwardly and terminating in a downflow effluent port 132. The general configuration of the downflow effluent port 132 will effect the efficiency of aeration and may provide horizontal (as shown) or vertical or angular (from about 30° to about 9° with the horizontal) discharge. The baffle 106 of the chamber 102 extends from the influent passage 112 radially outwardly to adjacent the chamber peripheral surfaces 110. Baffle 128 extends from the peripheral surface 110A to adjacent the influent passage 112.

The influent passage 112 is separated from the effluent passage 114 by an axially-extending section from which baffles 106 and 130 extend, the passage 112 being communicated with the interior of chamber 102 adjacent baffle 106.

The peripheral region 124 is formed by the extremity 126 of the separating baffle 118 and the peripheral surfaces 110A and 110B. Surface 110A extends axially with respect to axis 22 while surface 110B extends inwardly toward axis 22, the surfaces 110A and 110B preferably intersecting upstream of the axial location of baffle 118. Surfaces 110A and 110B, however, may intersect at or downstream of the axial location of baffle 118. Thus, the peripheral region 124 and the downflow effluent passage 114 are in communication along surface 110A and 110B, surface 110A forming part of the passage 114.

Each upstream region 120 of chambers 102 is isolated from adjacent chambers by means of the axially extending baffles 111 which also extend radially outwardly from wall 134 to peripheral surfaces 110A and 110B. In addition, the downflow effluent passage 114 is divided into a multiplicity of isolated sub-passages 114A, B by the baffles 111.

Each of the downstream regions 122 of chamber 102 is formed by the separating baffle 118, peripheral surface 110B, downstream baffle 108, and the upper or downstream portion 111B of the circumferentially-spaced axially-extending baffles 111, baffles 111 extending axially from the downflow effluent passage 114 to the downstream region 122. The lower or upstream portions 111A of the baffles 111 are disposed to separate adjacent sub-passages 114A, B and to isolate adjacent upstream regions 120. Downstream or upper baffle portion 111B extends from surface 110B radially inwardly to adjacent downstream shaft 138 of the apparatus. Baffle 108 extends radially inwardly from surface 110B to or adjacent to the inner peripheral extremity of the upper baffle portions 111B. Preferably the radius of the inner extremity of baffle 108 is greater than the radius of the inner extremity of upper baffle portions of baffle portions 111B, and is configured as a V-notch wier. An annular region 140 is provided which is common to all of the downstream regions 122.

Baffle 144, extends radially inwardly to and beyond the inner peripheral extremity of the upper baffle portions 111B and the inner extremity of baffle 108. Baffle 144 together with baffle 108, surface 110B and upper baffle portion 111B form the upflow effluent passage 116. The upflow effluent passage 116 is subdivided into multiplicity of isolated passages 116A, B . . . by axially extending baffles 148. Baffles 108, 144 and 148 extend radially outwardly to form upflow effluent ports 146. Axial baffles 148 between baffles 108 and 144 may be curved appropriately to improve energy efficiencies of the overall device through kinetic energy recovery from the upflow effluent discharge. An annular upflow effluent collector 150 is disposed in communication with each of the effluent ports 146 to collect the effluent discharge therefrom. A single upflow effluent discharge port 152 is provided for collector 150.

It is pointed out that baffles 144, 108, 118, 106, 128 and 130 are of overall disc-like or annular configuration when considering the housing 104 as a whole.

A central opening 155 in the top surface 157 of collector and a central opening 159 in baffle 144 provide venting from the interior of the downstream chambers and permit access thereto for observation or to obtain samples. Surface 157 and baffle 144 prevent the liquid being collected from splashing out of apparatus 100. If the apparatus 100, however, is operated in an enclosure such as a tank having a cover, surface 157 and baffle 144 may be omitted, if desired. Also, if desired, surface 157 and baffle 144 may extend to the shaft 138 with holes being disposed in surface 157 and in baffle 144 for venting.

The influent passage 112 is formed co-axially with the axis of rotation 22 and its upstream end 153 is disposed in a reservoir of mixture to be separated. The housing 104 and all its contents, the downstream shaft 138 and the upstream influent passage 112 are rigidly connected for rotation as a unit. Conventional means, not shown, are provided for rotating the chamber housing and the upstream and downstream portions of the apparatus. The collector 150 remains stationary and means may be provided to seal the collector and the rotating chamber.

In operation, the apparatus 100 is rotated about axis 22 and influent mixture is pumped into passage 112. This may be accomplished by means of a separate pump or the passage 112 may be an inverted truncated cone as illustrated in FIG. 2 which extends into the mixture and is provided with axially-extending vanes 154 which also extend into the mixture in the reservoir. The rotating vanes in combination with the conical configuration of passage 112 provide a pumping action and pump the mixture into the influent passage 112. The mixture proceeds downstream in passage 112 and is introduced into the upstream region 120 of the chamber 102 adjacent the axis of rotation 22. As described above for the embodiment shown in FIG. 1, the influent mixture in upstream chamber 120 is divided into two parts, a major part proceeding into the downflow effluent passage 114 and the minor part proceeding into the peripheral region 124. The factors which determine the division are the pumping rate of the external pump or truncated conical pump, the relative displacement of the inner extremities of the radially extending baffles 108 and 128 from the axis of rotation, the cross-sectional area of peripheral region 124 as defined by the outer extremity of radial baffle 118 and the surface 110B, the cross-sectional area of downflow passage 114 and the cross-sectional area of upstream region 120. The mixture is pumped up into region 120 of the chamber 102 as the apparatus is rotated and fills the upstream region 120 and the downstream region 122, thus creating a flooded zone between baffles 128 and 108. Apertures 160 are provided in baffle 118 adjacent shaft 138 to permit air between baffle 118 and the flooded passage 112 to be removed. Means may be provided to regulate the size of the apertures or close the apertures to control the removal of air. As pumping progresses so that more mixture is introduced into region 120 within the flooded zone, mixture spills over the inner extremity of baffle 128 from which it is discharged through port 132. Mixture also spills over the inner extremity of baffle 108 into passage 116 from which it is discharged through port 146. Of course, as apparatus 100 is rotated faster, more mixture will flow up in passage 112 to increase the separating capacity of the apparatus. However, the maximum separating capacity is limited by the rate of flow in the downstream region 122 and the quality of separation desired. Separation of solids and liquids otherwise occurs generally as described for FIG. 1, the separation being controlled by flow rates and turbulence as described for FIG. 1.

Referring now to FIG. 3, the apparatus of FIG. 2 is illustrated in which the flow of the mixture is shown. An upflow is provided in the influent passage 112 with mixture being removed therefrom into the upstream region 120 of the chamber. The major part of the mixture in region 120 is removed therefrom through downflow effluent passage 114. The minor part of the mixture proceeds through peripheral region 124 into the downstream region 122 and is separated into solids and liquids. The solids form part of the downflow and progress down through peripheral region 124 into passage 114 to be discharged from the apparatus with the major part of the mixture. The separated liquids move radially inwardly into the annular region 140 and are centrifuged therefrom into the effluent discharge ports 146. More specifically the minor part of the mixture entering the peripheral region proceeds into a quiescent zone in region 122 and separation of solids and liquids in the minor part of the mixture takes place. The solids are centrifuged outwardly and form part of the effluent downflow, proceeding upstream in peripheral region 124 to join the effluent downflow of the major part of the mixture. The major part of the mixture and the separated solids are discharged from downflow effluent port 132. The separated liquids in the upstream region 122 move inwardly into the annular region 140 and then proceed outwardly into the effluent ports to be discharged into the collector 150. A highly clarified effluent is obtained from discharge port 152.

The peripheral region 124 in the separator of FIG. 2 is formed, as mentioned, adjacent the extremity 126 of baffle 118 and the two surfaces, 110A and 110B. Surface 110A extends axially and forms part of the upstream region 120. This axially-extending surface creates a zone of high turbulence, by redirecting the major part of the mixture flow into the downflow effluent passage. The surface 110B extends at an angle inwardly from the axially-extending surface 110A and reduces turbulence as the surface progresses inwardly toward the radial plane and extremity 126 of baffle 118 and beyond. Thus, the turbulence decreases as the peripheral region 124 extends downstream. Within the downstream region 122, turbulence is substantially eliminated by divergence of the surface 110B and baffle 118 and the quiescent zone thereby provided. The centrifugal force and the low shear forces act to provide separation of the solids and liquids in the quiescent zone 122, and in the region of transition from peripheral region 124 to region 122. While extending surface 110 inwardly is preferred, surface 110 may extend axially from surface 110A. In such a case, it is preferred that the corner formed by surface 110B (axially-extending) and baffle 108 be filleted to avoid a dead space.

Referring now to FIG. 4, a portion of apparatus 100 of FIG. 2 is illustrated in which the solids distribution, solids flow and flow turbulence in the apparatus are depicted. The major part of the solids proceed with the liquid as a mixture as described for FIG. 3, into the upstream region 120 and into the downflow effluent discharge passage 114. A minor part of the mixture proceeds into the peripheral region 124 where turbulence is reduced as the peripheral region progresses into the downstream region 122. The solids are separated in the downstream region adjacent the peripheral region 124 and returned through the peripheral region to the upstream region and hence to the downflow in the discharge passage 114.

As described for apparatus 10, the baffles 111 are spaced to provide low shear forces and reduce slippage between the mixture and the rotating chamber surfaces.

As described for FIG. 1, separation and removal of liquids is on a continuous basis and separation and removal of solids is also on a continuous basis.

In some applications, it is highly desirable to aerate the discharged solids and the major part of the solids-liquid mixture before returning the same to the mixture reservoir. Thus, the downflow effluent port 132 is advantageously spaced from the mixture level in the reservoir as described for the embodiment of FIG. 1 and the discharged effluent must pass through a layer of air before being returned to the reservoir. Further, the impact of the returning discharged mixture on the surface of the bulk mixture entrains air bubbles in the bulk mixture and induces mixing in the body of the mixture.

While the apparatus described above is useful in separating solids and liquids in many types of solids-liquid mixtures, the invention is particularly suited to separating solids and liquids in a solids-liquid sewage mixture and obtaining a highly clarified effluent. Specifically, the invention is especially suited for use in activated sludge systems for biological waste water treatment. Advantageously, the invention prevents fragmentation of the delicate biological sludges since shear forces in the separating zone are held to a minimum. The invention permits the bulk of the mixture introduced into the separating apparatus to be aerated continuously during separation of solids and liquids, both separation and aeration being accomplished with one source of power. For the embodiment described in FIG. 1, this device may be utilized to provide highly clarified effluent for analytical purposes.

The advantages of the present invention, as well as certain changes and modifications of the disclosed embodiments thereof, will be readily apparent to those skilled in the art. For example, means other than baffles may be used to form the rotating chamber and the upstream and downstream regions. It is within the contemplation of the invention to utilize valving, for example, to communicate the upstream and downstream regions and to utilize valving to accomplish division of the mixture in the upstream region into a major part which is removed from the chamber and a minor part which is supplied to the downstream region. Such additional means may also provide the turbulent and quiescent zones. Additionally, shapes and configurations of chambers, upstream regions, downstream regions other than those illustrated and described may be utilized. It is the applicant's intention to cover by his claims all those changes and modifications which could be made to the embodiments of the invention herein chosen for the purposes of the disclosure without departing from the spirit and scope of the invention.

What is claimed is:

1. Apparatus for continuously separating solids and liquids in a solids-liquid mixture and continuously removing the separated solids and liquids from the apparatus comprising:

an upstream chamber and a downstream chamber connected in said apparatus for rotation about an axis of rotation;

means for introducing mixture into said upstream chamber, said upstream chamber being structured to cause mixture introduced therein to move outwardly from said means for introducing upon rotation of said upstream chamber;

means for communicating said upstream chamber and said downstream chamber such that mixture moving outwardly in said upstream chamber during rotation thereof can move into said downstream chamber through said means for communicating;

first means for removing mixture from said upstream chamber and discharging it from the apparatus;

means cooperating with said means for communicating and said first means for causing a major part of the mixture in the upstream chamber to be removed therefrom through said first means and for causing a minor part of the mixture to be removed therefrom to said downstream chamber through said means for communicating;

said first means causing mixture removed from the upstream chamber substantially to reverse direction before being discharged from the apparatus;

second means for removing liquid from said downstream chamber;

said upstream and downstream chambers, said means for communicating and said first means being operative to provide a region of low turbulence to mixture in the downstream chamber relative to turbulence in the upstream chamber during rotation of said chambers such that liquid is separated from mixture in said downstream chamber and moves toward said second means through which the separated liquid is removed from said downstream chamber.

2. The apparatus as recited in claim 1, wherein each said chamber is defined by respective upstream and downstream surfaces axially spaced apart extending outwardly substantially from the axis of rotation, spaced surfaces extending transversely between respective upstream and downstream surfaces outwardly from substantially the axis of rotation and a chamber peripheral surface extending transversely to said upstream and downstream surfaces and transversely to said spaced surfaces.

3. The apparatus as recited in claim 2, wherein said upstream and downstream surfaces extend radially outwardly.

4. The apparatus as recited in claim 2, wherein said peripheral surface of the downstream chamber includes a surface having a radially-extending component which extends to said downstream surface of said downstream chamber.

5. The apparatus as recited in claim 1, wherein said downstream chamber has a Reynolds number which is substantially greater than the Reynolds number in said upstream chamber.

6. The apparatus as recited in claim 5, wherein said downstream chamber has a Reynolds number of less than about 3000.

7. The apparatus as recited in claim 1, wherein said downstream chamber is structured to provide high centrifugal forces and low shear forces to mixture therein during rotation of said downstream chamber.

8. The apparatus as recited in claim 1, wherein said means for introducing comprises means for removing mixture from a source of the mixture and a passage in communication with said upstream chamber which is adapted to be communicated with the source of the mixture.

9. The apparatus as recited in claim 8, wherein said means for removing mixture from the source thereof comprises pumping apparatus.

10. The apparatus as recited in claim 9, wherein said pumping apparatus is coupled to said passage to pump mixture therethrough into said upstream chamber.

11. The apparatus as recited in claim 9, wherein said pumping apparatus comprises a hollow generally conically-configured shaft, the larger end of which is in communication with said upstream chamber and the smaller end of which is adapted to being communicated with a source of mixture, said shaft having a plurality of generally axially-extending vanes disposed therein.

12. The apparatus as recited in claim 1, wherein said second means includes a passage in communication with said downstream chamber and pumping apparatus coupled to said passage to pump fluid from said downstream chamber.

13. The apparatus as recited in claim 1 and comprising a plurality of each of said chambers circumferentially disposed about the axis of rotation.

14. The apparatus as recited in claim 8, wherein said means for introducing is communicated with said upstream chamber adjacent the axis of rotation and said first means is communicated with said upstream chamber adjacent the periphery thereof.

15. The apparatus as recited in claim 14, wherein said first means includes a passage communicating with said upstream chamber outwardly of said means for introducing which extends inwardly to adjacent the axis of rotation.

16. The apparatus as recited in claim 15, wherein said passage extends radially inwardly to adjacent the axis of rotation.

17. The apparatus as recited in claim 1, wherein said second means is communicated with said downstream chamber adjacent the axis of rotation.

18. The apparatus as recited in claim 15, wherein said means for introducing extends axially to said upstream chamber.

19. The apparatus as recited in claim 1, wherein said first means includes outlet means for discharging separated solids and said major part of the mixture from the apparatus, said outlet means being spaced above a reservoir of the solids-liquid mixture from which mixture is drawn into the apparatus such that the separated solids and mixture can be aerated when discharged from said outlet means.

20. The apparatus as recited in claim 2, wherein said peripheral surface of each chamber extends substantially parallel to the axis of rotation.

21. The apparatus as recited in claim 2, wherein said peripheral surface of said upstream chamber extends substantially parallel to the axis of rotation and said peripheral surface of said downstream chamber includes a surface portion extending inwardly towards the axis of rotation.

22. The apparatus as recited in claim 1, wherein the downstream chamber is structured such that during rotation thereof separated liquid moves inwardly toward said second means and solids move outwardly towards said means for communicating through which the solids are removed from said downstream chamber.

23. The apparatus as recited in claim 22, wherein said first means is communicated with said upstream chamber so as to remove solids passing through said means for communicating and discharge said solids together with mixture removed from the upstream chamber through said first means.

24. The apparatus as recited in claim 1, wherein said first means includes a passage communicating with said upstream chamber outwardly of said means for introducing which extends inwardly to adjacent the axis of rotation, thereby causing mixture removed from said upstream chamber through said first means to substantially reverse direction before being discharged.

25. The apparatus as recited in claim 1, wherein the means for causing comprises pumping apparatus.

26. Apparatus for continuously separating solids and liquids in a solids-liquid mixture and continuously removing the separated solids and liquids from the apparatus comprising:

generally cylindrical housing connected in said apparatus for rotation about the axis of said housing;

a disc-like baffle member disposed substantially centered on said axis and extending radially therefrom to adjacent the periphery of the housing, said disc-like member separating said housing into an upstream region and a downstream region, there being a peripheral region between said disc-like baffle member and the periphery of said housing;

an upstream conduit extending coaxially with said axis into said housing and in communication with said upstream region;

a first annular baffle member disposed substantially centered on said axis and spaced upstream from said disc-like baffle member, said first annular baffle member extending radially from said upstream conduit to adjacent the periphery of said housing and forming a turbulent region with said disc-like baffle member;

a second annular baffle member disposed substantially centered on said axis in said downstream region;

a third annular baffle member axially spaced in the upstream direction from said first annular baffle member and extending from the periphery of the housing inwardly to adjacent said conduit;

a plurality of additional baffle members extending in said upstream region axially from said first annular baffle member to said disc-like baffle member and outwardly from said conduit to the periphery of said housing, and in said downstream region axially from said disc-like baffle member to said second annular baffle member and inwardly from said periphery of said housing a predetermined distance terminating spaced from said axis, said second annular baffle member extending from said predetermined distance outwardly to the periphery of said housing; said housing thereby being defined by a plurality of upstream regions spaced about the axis of rotation, a centrally located cavity in the downstream region, and a plurality of downstream regions in communication with said central cavity and spaced about the axis of rotation;

said second annular baffle member being axially spaced from a surface forming the downstream end of the housing, said housing being open between said downstream end and said second annular baffle member.

27. The apparatus recited in claim 26, and including additional baffle members extending axially between said downstream end and said second annular baffle member.

28. The apparatus as recited in claim 27, wherein the periphery of said housing is defined by a cylindrical segment and a conical segment, said segments intersecting adjacent said upstream region, with said cylindrical segment extending in the direction of said upstream region and said conical segment extending in the direction of said downstream region.

29. The apparatus as recited in claim 27 and including additional baffle members axially extending between said first annular baffle member and said third annular baffle member.

30. The apparatus as recited in claim 26 and including inlet means for admitting mixture into the apparatus in communication with said upstream conduit and outlet means for discharging effluent in communication with a passage formed between said first and third baffle members, said outlet means being disposed at a greater vertical height than said inlet means, whereby effluent can be aerated when discharged from said outlet means.

31. A method for continuously separating solids and liquids in a solids-liquid mixture in an apparatus having an upstream chamber, a downstream chamber, means for introducing mixture into the upstream chamber, means for communicating the upstream and downstream chambers, first means for removing mixture from the upstream chamber and discharging it from the apparatus and second means for removing liquid from the downstream chamber, the method comprising the steps of rotating the upstream and downstream chambers, causing mixture to be continuously introduced into the upstream chamber through the means for introducing, causing mixture in the upstream chamber to move toward the means for communicating and the first means, causing a minor part of the mixture to be removed from the upstream chamber to the downstream chamber through the means for communicating, causing a major part of the mixture introduced into the upstream chamber to move towards the first means and undergo at least one substantial reversal in flow direction before being discharged from the apparatus, establishing a first flow turbulence in the upstream chamber, establishing a second flow turbulence in the downstream chamber which is lower than the first flow turbulence, causing separation of solids and liquids in the minor part of the mixture in the downstream chamber, causing the separated solids to be removed from the downstream chamber, and causing the separated liquid in the downstream chamber to move towards the second means and to be removed from the downstream chamber therethrough.

32. The method as recited in claim 31, wherein the mass flow in the downstream chamber is maintained substantially less than the mass flow in the upstream chamber.

33. The method as recited in claim 32, wherein the mass flow in the downstream chamber is maintained below the terminal settling velocity of the solids in the mixture.

34. The method as recited in claim 31, wherein shear forces are maintained low in the downstream chamber and while subjecting the mixture to the centrifugal force from rotation.

35. The method as recited in claim 31 and including the step of discharging mixture and separated solids above a reservoir of the mixture such that the mixture and separated solids can be aerated.

36. The method as recited in claim 31, wherein the separated solids are caused to be removed from the downstream chamber through the means for communicating.

37. The method as recited in claim 36, wherein the separated solids are caused to be removed from the apparatus through the first means.

* * * * *

UNITED STATES PATENT AND TRADEMARK OFFICE

CERTIFICATE OF CORRECTION

PATENT NO. : 4,434,061

DATED : February 28, 1984

INVENTOR(S) : Curtis S. McDowell

It is certified that error appears in the above-identified patent and that said Letters Patent is hereby corrected as shown below:

On the first page of the patent, at the top of the left-hand column adjacent "[73] Assignee", delete "Cellu-Craft Inc., New Hyde Park, N.Y." and insert therefor the correct Assignee as follows --Polybac Corporation, Allentown, PA.--.

Also on the first page of the patent, in the right-hand column adjacent "Attorney, Agent, or Firm", delete "Posnack, Roberts, Cohen & Spiecens" and insert therefor --Kenyon & Kenyon--.

Column 9, line 5, "9°" should read --90°--.

Signed and Sealed this

*Tenth* Day of *July 1984*

[SEAL]

*Attest:*

GERALD J. MOSSINGHOFF

*Attesting Officer*

*Commissioner of Patents and Trademarks*